US005163634A

United States Patent [19]

Moon et al.

[11] Patent Number: 5,163,634

[45] Date of Patent: Nov. 17, 1992

[54] FENCE STRETCHING APPARATUS

[76] Inventors: L. T. Moon, RFD #2 Box 2192, Homer, Ga. 30547; Ned Cagle, Bryant Quarters Rd., Gillsville, Ga. 30543

[21] Appl. No.: 475,413

[22] Filed: Feb. 5, 1990

[51] Int. Cl.[5] ..... B65H 23/02

[52] U.S. Cl. ..... 242/86.5 R; 242/86.7; 140/123.5; 256/37

[58] Field of Search ..... 242/86.5 R, 86.52, 86.7; 140/123.5; 256/37, 40, 42

[56] References Cited

U.S. PATENT DOCUMENTS

| | | | |
|---|---|---|---|
| 2,914,270 | 11/1959 | Parker et al. | 242/86.5 R |
| 3,048,348 | 8/1962 | Griffin | 242/86.5 R |
| 3,104,863 | 9/1963 | De Forest | 242/86.5 R |
| 3,934,655 | 1/1976 | Whistle | 242/86.5 R |
| 4,208,021 | 6/1980 | Wall | 242/86.5 R |
| 4,775,114 | 10/1988 | Farnsworth | 242/86.5 R |
| 4,930,718 | 6/1990 | Lancour et al. | 242/86.5 R |

*Primary Examiner*—Daniel P. Stodola
*Assistant Examiner*—John Q. Nguyen
*Attorney, Agent, or Firm*—Leon Gilden

[57] ABSTRACT

An apparatus including an upper triangular framework parallel to and spaced above a lower triangular framework in an aligned relationship, wherein a slide yoke is mounted between spaced, aligned upper legs of the upper and lower triangular frameworks, wherein the yoke is mounted to a rear vertical leg to vary a gap defined between a forward vertical leg and a forward vertical leg of the yoke. The apparatus further includes a first, second, and third support mount for securement to a three-point hitch of a tractor. A hydraulic member includes hydraulic lines mounted to a rear vertical leg and to a slidable forward leg of the yoke with the lines securable to a hydraulic system of an associated tractor.

1 Claim, 4 Drawing Sheets

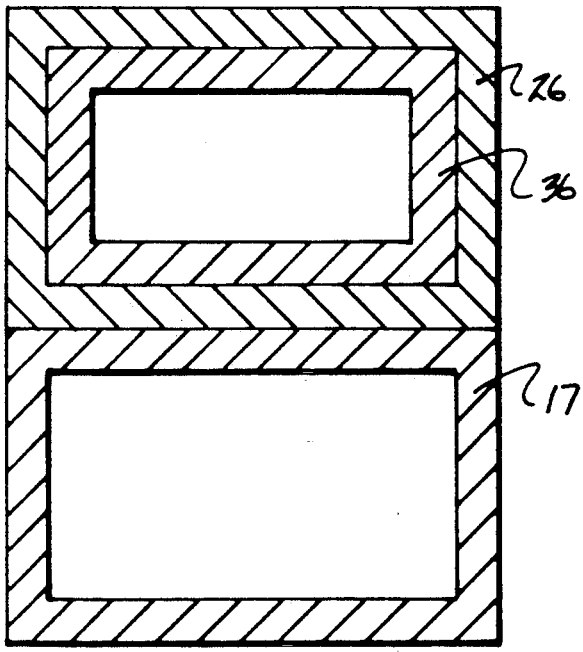
FIG 3
FIG 4
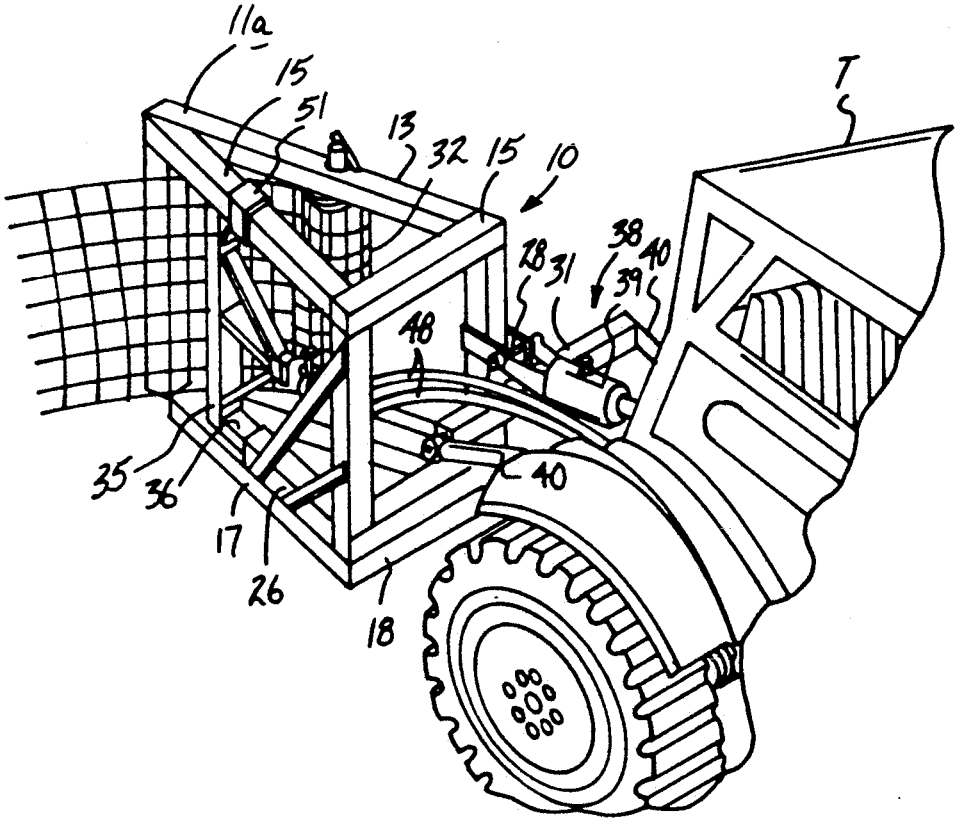

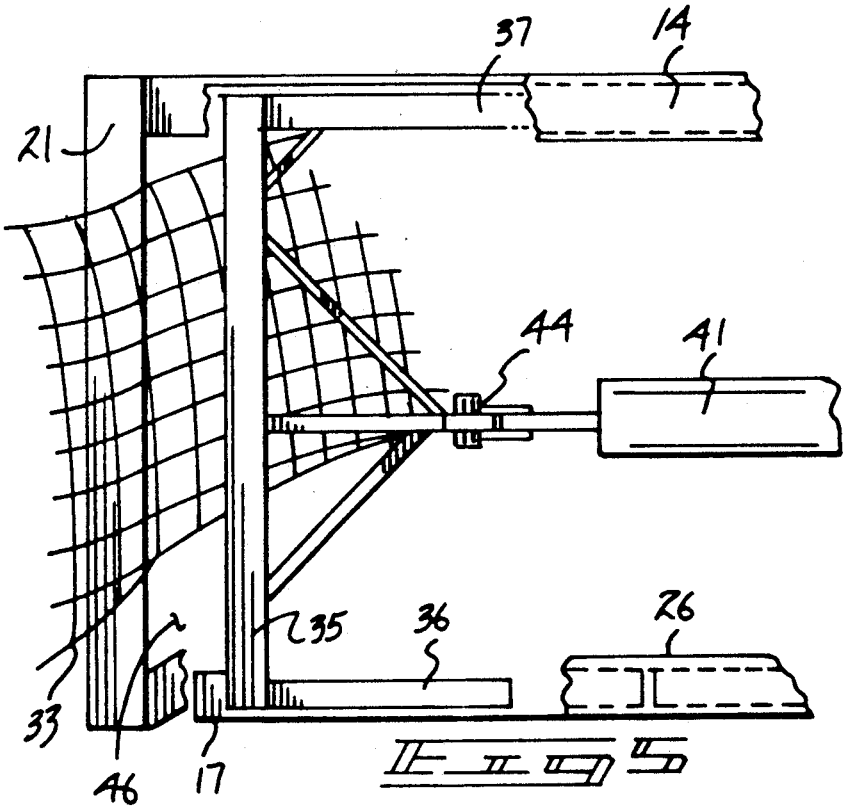
Fig 5
Fig 6
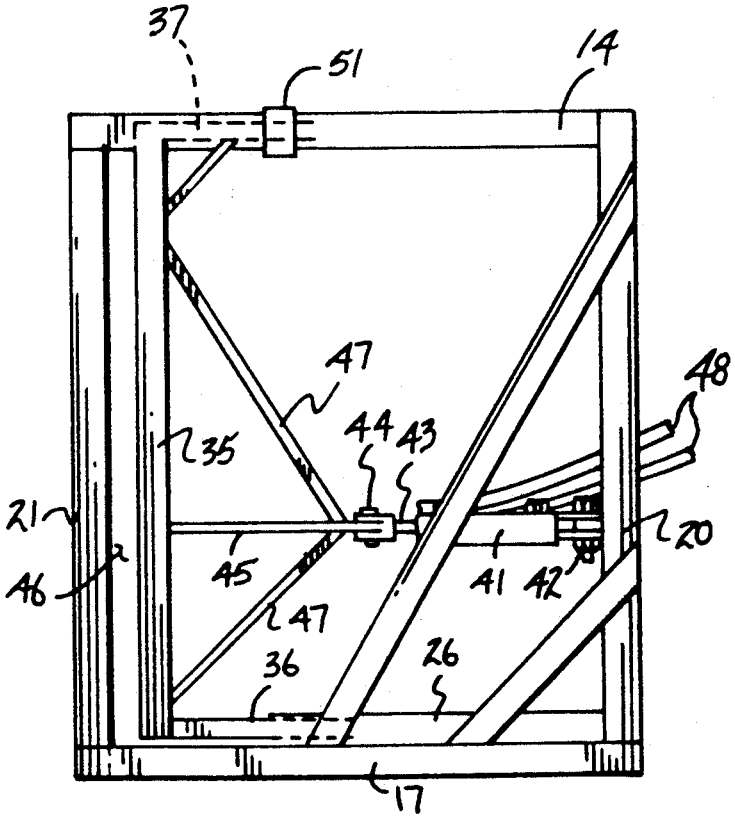

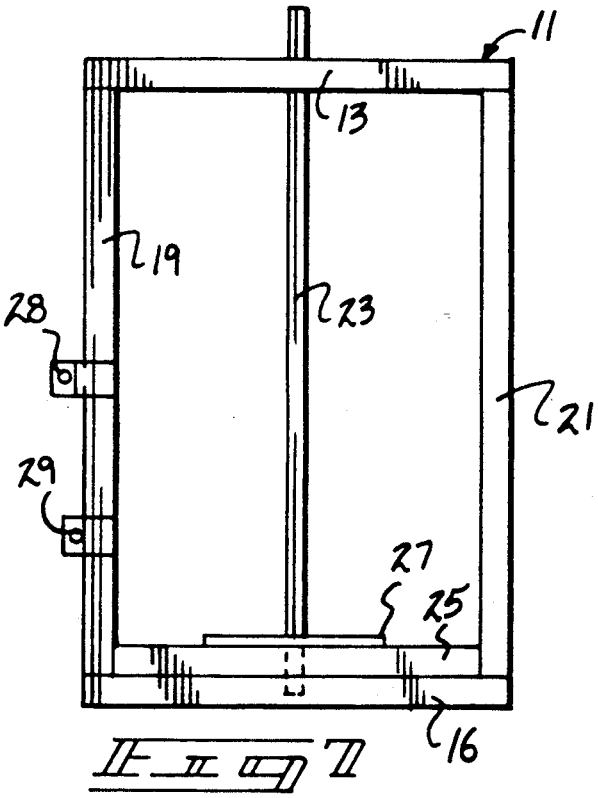
FIG 7
FIG 8
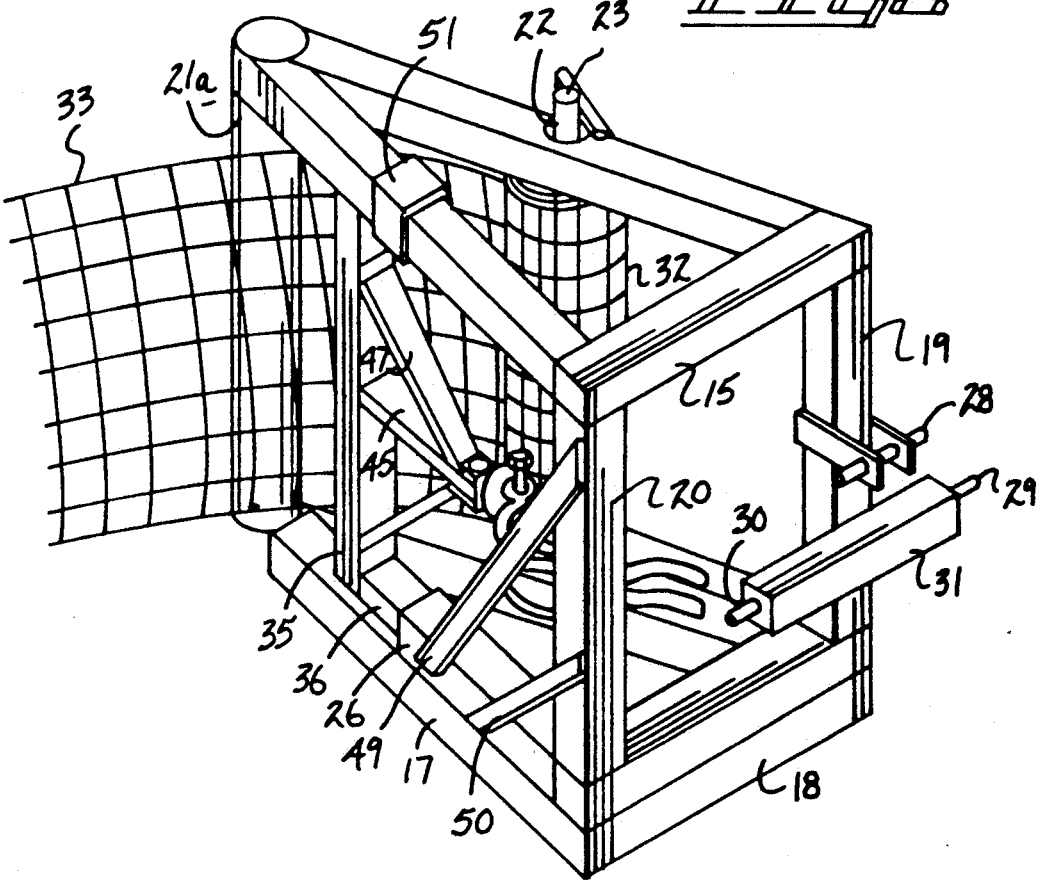

FENCE STRETCHING APPARATUS

BACKGROUND OF THE INVENTION

1. Field of the Invention

The field of invention relates to fence stretching apparatus, and more particularly pertains to a new and improved fence stretching apparatus wherein the same is readily and efficiently securable to a tractor to effect a fence stretching and positioning operation.

2. Description of the Prior Art

Fence stretching apparatus is known in the prior art, but has heretofore been limited to relatively complex and expansive structural organizations. The instant invention attempts to overcome the limitations of the prior art by providing a fence stretching apparatus readily securable to an associated tractor for a fence stretching and positioning operation. Examples of the prior art include U.S. Pat. No. 3,722,861 to Anderson wherein a fence feeding and stretching device is mounted to a forward end of a truck, wherein the truck directs the roll adjacent a fence line. The apparatus fails to provide the fence engaging structure of the instant invention defining an adjustable gap to direct a fence therethrough.

U.S. Pat. No. 4,338,977 to McNully sets forth a wire stretching apparatus for stretching a single wire between fence posts utilizing a cylindrical grooved roll to receive a single wire therethrough to enable twisting of the wire adjacent a remote fence post to effect a stretching operation. The patent fails to provide the stretching effect of the instant invention as applied to a matrix of wires defining a fence.

U.S. Pat. No. 3,104,686 to Wise utilizes a wire stretching tool to apply a stretching to a single wire strand.

U.S. Pat. No. 2,859,944 to Cisney sets forth a wire tensioning apparatus addressed to a wire matrix, wherein a manual displaceable roll secures an end of a fence therebetween, wherein use of a levering mechanism enables a stretching of the fence relative to an associated post.

U.S. Pat. No. 4,057,221 to Leath sets forth a stretching tool for individual wire strands of a fence, wherein the tool is wrapped around an individual fence and left in position to provide a permanent stretching of a single wire of a fence organization.

As such, it may be appreciated that there continues to be a need for a new and improved fence stretching apparatus wherein the same addresses both the problems of ease of use, as well as effectiveness in construction and in this respect, the present invention substantially fulfills this need.

SUMMARY OF THE INVENTION

In view of the foregoing disadvantages inherent in the known types of fence stretching apparatus now present in the prior art, the present invention provides a fence stretching apparatus wherein the same is readily and conveniently securable to an associated tractor to effect a fence stretching and applying procedure. As such, the general purpose of the present invention, which will be described subsequently in greater detail, is to provide a new and improved fence stretching apparatus which has all the advantages of the prior art fence stretching apparatus and none of the disadvantages.

To attain this, the present invention provides an apparatus including an upper triangular framework parallel to and spaced above a lower triangular framework in an aligned relationship, wherein a slide yoke is mounted between spaced, aligned upper legs of the upper and lower triangular frameworks, wherein the yoke is mounted to a rear vertical leg to vary a gap defined between a forward vertical leg and a forward vertical leg of the yoke. The apparatus further includes a first, second, and third support mount for securement to a three-point hitch of a tractor. A hydraulic member includes hydraulic lines mounted to a rear vertical leg and to a slidable forward leg of the yoke with the lines securable to a hydraulic system of an associated tractor.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved fence stretching apparatus which has all the advantages of the prior art fence stretching apparatus and none of the disadvantages.

It is another object of the present invention to provide a new and improved fence stretching apparatus which may be easily and efficiently manufactured and marketed.

It is a further object of the present invention to provide a new and improved fence stretching apparatus which is of a durable and reliable construction.

An even further object of the present invention is to provide a new and improved fence stretching apparatus which is susceptible of a low cost of manufacture with regard to both materials and labor, and which accordingly is then susceptible of low prices of sale to the consuming public, thereby making such fence stretching apparatus economically available to the buying public.

Still yet another object of the present invention is to provide a new and improved fence stretching apparatus which provides in the apparatuses and methods of the prior art some of the advantages thereof, while simultaneously overcoming some of the disadvantages normally associated therewith.

Still another object of the present invention is to provide a new and improved fence stretching apparatus wherein the same enables convenient securement to an associated tractor to enable the tractor to position and manipulate the organization to effect a fence stretching operation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an orthographic view taken along the lines 3—3 of FIG. 2 in the direction indicated by the arrows.

FIG. 4 is an isometric illustration of the instant invention in association with a conventional tractor.

FIG. 5 is an orthographic side view taken in elevation of the instant invention.

FIG. 6 is a further orthographic side view taken in elevation of the instant invention.

FIG. 7 is an orthographic right side view taken in elevation of the instant invention.

FIG. 8 is an isometric illustration of the instant invention utilizing a cylindrical guide link at the mouth of the gap formed by the apparatus.

DESCRIPTION OF THE PREFERRED EMBODIMENT

Figure 1:
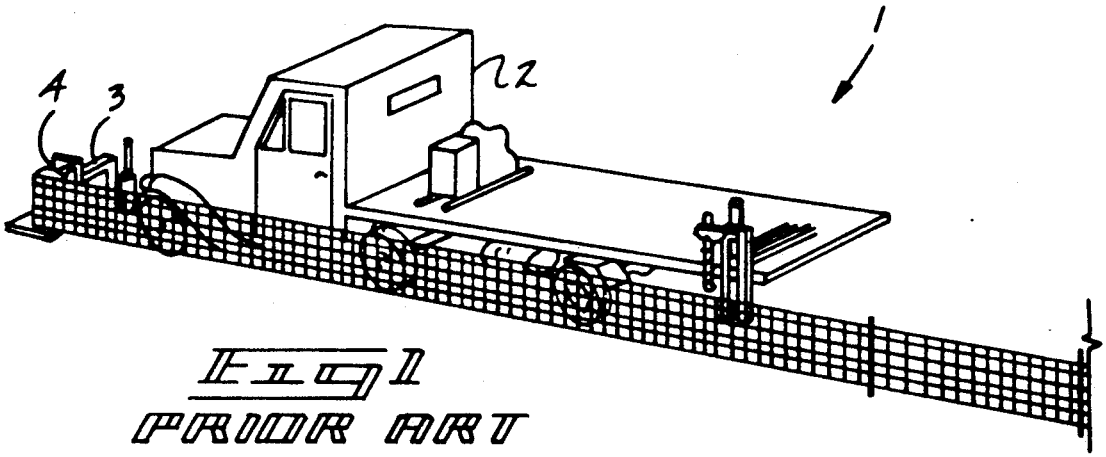
Fig 1 PRIOR ART
FIG. 1 is an isometric illustration of a prior art fence stretching apparatus.

With reference now to the drawings, and in particular to FIGS. 1 to 8 thereof, a new and improved fence stretching apparatus embodying the principles and concepts of the present invention and generally designated by the reference numeral 10 will be described.

FIG. 1 is illustrative of a prior art fence stretching device 1 mounted to an associated truck 2, wherein the organization includes a framework 3 mounting a roll of fence wire 4 thereto, wherein the roll is directed along a fence line during the truck's traverse thereof and secured to associated fence posts.

Figure 2:
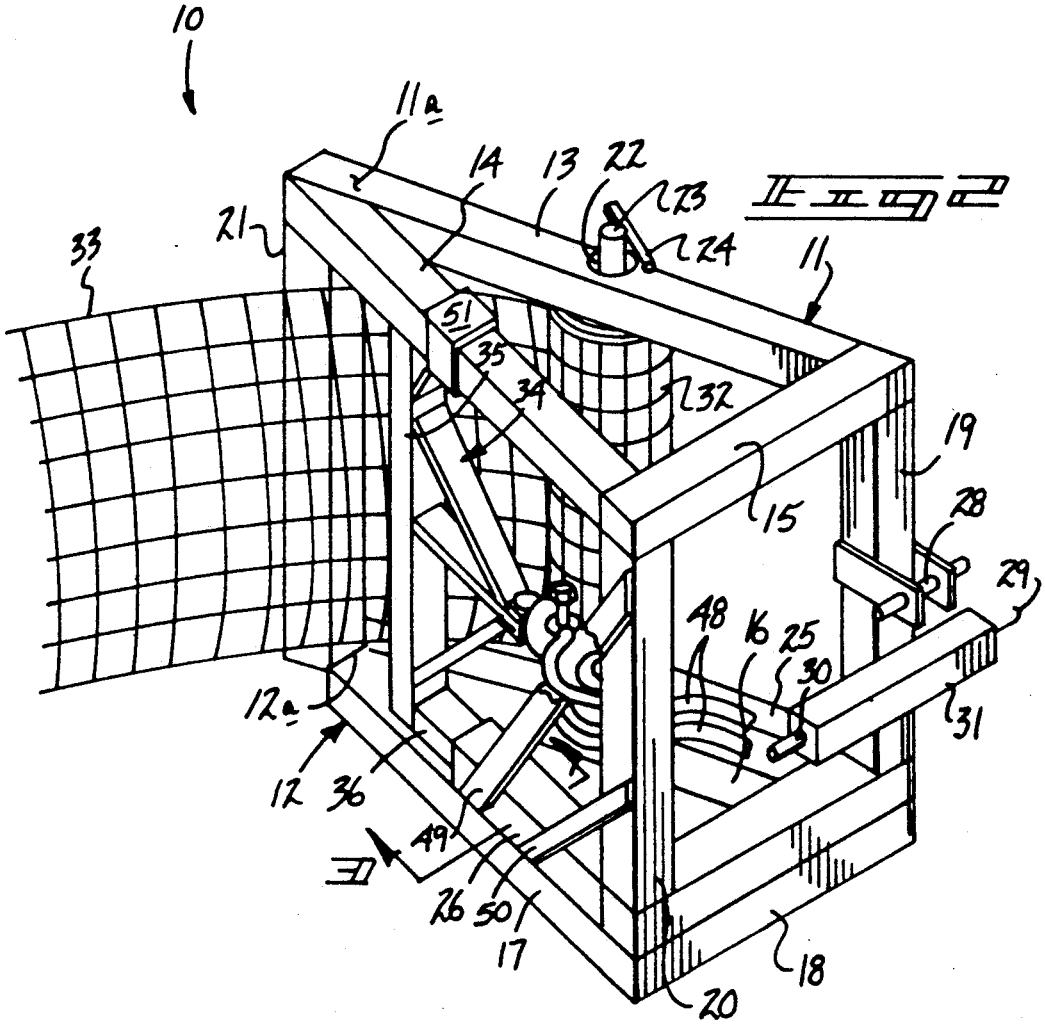
FIG. 2 is an isometric illustration of the instant invention.

More specifically, the fence stretching apparatus 10 of the instant invention essentially comprises a top triangular framework 11 spaced parallel above and coextensive with a bottom triangular framework 12. The top and bottom triangular frameworks include forward and aligned apex portions including a top apex 11*a* overlying a bottom apex 12*a*. The top triangular framework further includes a top first leg 13 spaced from a top second leg 14, with a top base leg 15 defining the top triangular framework 11. The bottom triangular framework 12 is defined by a bottom first leg 16, a bottom second leg 17, and a bottom base leg 18, wherein the bottom base leg 18 is parallel to and spaced in aligned relationship below the top base leg 15. A first vertical leg 19 and a second spaced parallel vertical leg 20 join opposed terminal ends of the base legs together. A forward guide leg 21 is mounted between the top apex 11*a* and the bottom apex 12*a*. The guide leg 21 is illustrated as a generally rectangular cross-sectional configuration, but a cylindrical guide leg 21*a*, as illustrated in FIG. 8 for example, may be utilized to minimize friction of the forward end 33 of the fence wire roll 32 as it is directed across the guide leg. A top aperture 22 is formed through-extending the top first leg 13 to receive a roll spindle shaft 23 rotatably therethrough. A biasing guide rod 24 is utilized to apply a degree of frictional restraint to the spindle shaft 23 preventing undesirable excessive unrolling of the fence wire roll 32 during a fence stretching procedure. FIG. 7 illustrates the roll spindle shaft 23 as it is directed through the top first leg 13 and positioned overlying the bottom first leg 16, with an annular spindle plate 27 rotatably mounted onto the bottom first leg 16 overlying a first bottom support leg 25 to rotatably mount the fence wire roll 32 at a desired elevation relative to a second bottom support leg 26 mounted upon the bottom second leg 17, as illustrated in FIG. 2 for example. The bottom second leg 17 slidably receives a bottom horizontal leg 36 of a slide yoke 34, with a top horizontal leg 37 of the slide yoke 34 slidably received within the top second leg 14 and maintaining a position therewithin by a surrounding sleeve 51 encompassing the top second leg 14 containing the top horizontal leg 37 therewithin. A slide yoke vertical leg 35 orthogonally and integrally secured to forward ends of the bottom horizontal leg 36 and the top horizontal leg 37 of the slide yoke defines a gap 46 between the slide yoke vertical leg 35 and the guide leg 21, as illustrated in FIGS. 5 and 6 for example. Adjustment of the gap determines the relative ease by which the forward end 33 of the fence is to proceed from the apparatus and thereby may effect a fence stretching upon the organization mounted to a tractor "T", as illustrated in FIG. 4.

The apparatus is secured to the tractor "T" utilizing a first shaft 28 orthogonally mounted across the first vertical leg 19, with a second and third shaft 29 and 30 extending beyond the first shaft 28 spaced parallel to and underlying the first shaft 28 and mounted coaxially relative to one another to a support block 31, also mounted integrally to the first vertical leg 19. In this manner, a tractor three-point hitch 38 includes a top hydraulic link 39 and spaced bottom support links 40 securable to the respective first shaft 28 and the second and third shafts 29 and 30 to enable a lifting and repositioning of the apparatus 10 as it is directed across the fence line and is stretched by adjustment of the gap 46, as noted above. The slide yoke 34 is adjusted to define the gap utilizing a hydraulic cylinder 41. Reference to FIG. 6 illustrates the hydraulic cylinder 41, including a rear hydraulic cylinder pivot 42 to pivotally mount the hydraulic cylinder orthogonally to the second vertical leg 20 at a rear end of the hydraulic cylinder, with a piston 43 reciprocatably mounted within the hydraulic cylinder. The forward end of the piston 43 includes a piston pivot 44 mounted at a forward end thereof pivotally secured to a piston link 45 that in turn is orthogonally and integrally secured to the slide yoke vertical leg 35. Spaced triangulated support links 47 are secured at one end to the piston link 45 adjacent the piston pivot 44 and mounted at their other ends in a spaced relationship to the slide yoke vertical 35, as illustrated in FIG. 6. Hydraulic cylinder fluid conduits 48 are operably connected to the hydraulic system of the associated tractor "T" to enable actuation of the hydraulic cylinder selectively by an operator within the tractor "T". A first and second respective diagonal support brace 49 and 50 are integrally mounted to the second vertical leg 20 and the second bottom support leg 26 to provide necessary integrity to the organization during operation of the hydraulic cylinder in adjusting of the gap 46 and in manipulation of the apparatus by the tractor "T".

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A fence stretching apparatus for use with a tractor having a three-point hydraulic hitch, the apparatus comprising, in combination, a top triangular framework spaced parallel to and coextensively overlying a bottom triangular framework, the top and bottom frameworks including first and second parallel vertical legs orthogonally and integrally mounted to rear end corner portions of the top and bottom frameworks to secure the top and bottom frameworks together, and a forward guide leg orthogonally mounted to respective forward terminal ends of the top and bottom frameworks, and a slide yoke slidably mounted to the top and bottom frameworks, wherein the slide yoke includes a yoke vertical leg defining an adjustable gap between the yoke vertical leg and the forward guide leg, and a spool of matrix fence wire mounted between the top and bottom frameworks having a fence wire forward end directed through the gap, and a force member mounted at its rearward end to the second vertical leg and pivotally mounted at its forward end to the yoke vertical leg to effect adjustment of the gap, and wherein the force member comprises a hydraulic cylinder, the hydraulic cylinder including a first pivot member pivotally mounting a rear end of the hydraulic cylinder to the second vertical leg, and the hydraulic cylinder including a piston reciprocatably mounted therewithin, the piston including a second pivot member mounting a forward end of the piston to a piston link, the piston link mounted at its forward end orthogonally, integrally, and medially to the yoke vertical leg, and wherein the slide yoke includes a bottom yoke leg and a top yoke leg, the bottom yoke leg slidably mounted overlying a second leg of the bottom framework, and the top yoke leg slidably mounted interiorly of a second leg of the top framework, and wherein the top framework includes top framework first leg jointed at its forward end to a top end portion of the forward guide leg, and including an aperture orthogonally directed therethrough, the aperture receiving a roll spindle shaft rotatably therethrough, the roll spindle shaft including an annular spindle plate fixedly mounted adjacent a lower terminal end of the roll spindle shaft and the lower terminal end of the roll spindle shaft rotatably mounted at its bottom end within a bottom framework first leg spaced from the bottom framework second leg, the bottom framework first leg and the bottom framework second leg integrally secured to the forward guide leg at a bottom terminal end of the forward guide leg, and wherein the first vertical leg includes a first shaft orthogonally mounted adjacent a rear face of the first vertical leg, and a second shaft and third shaft coaxially aligned with one another and mounted underlying and in a parallel spaced relationship relative to the first shaft, wherein the second shaft and the third shaft axially extend beyond the first shaft, wherein the second shaft and third shaft are mounted to a support block, the support block integrally mounted to the rear face of the first vertical leg, and wherein the first, second, and third shafts are securable to the three point hitch of the tractor, and wherein the bottom framework second leg includes a bottom support leg mounted thereon, with the bottom support leg slidably receiving the bottom yoke leg therewithin, and the second leg of the top framework slidably receiving the top yoke leg, and a sleeve surroundingly encompassing the top yoke leg and the second leg of the top framework, and wherein the bottom framework first leg includes a first bottom support leg mounting the annular spindle plate thereon to position the annular spindle plate at a predetermined aligned height relative to the bottom framework second leg and position the forward end of the fence wire roll relative to the gap, and wherein the forward guide leg is cylindrical to minimize abrasion between the fence wire and the forward guide leg, and further including spaced first and second diagonally oriented support braces having ends integrally secured to the second vertical leg between the top and bottom frameworks and the bottom framework second leg to effect rigidity and geometrical integrity to the apparatus.

* * * * *